US007819245B1

(12) United States Patent
Singh et al.

(10) Patent No.: US 7,819,245 B1
(45) Date of Patent: Oct. 26, 2010

(54) CLAM SHELL PACKAGING FOR WHEEL DEVICE

(75) Inventors: Amit Singh, Toronto (CA); Jeffery Balaban, Laguna Niguel, CA (US); David Wroniak, Garden Grove, CA (US)

(73) Assignee: Division Six Sports, Inc., Encino, CA (US)

( * ) Notice: Subject to any disclaimer, the term of this patent is extended or adjusted under 35 U.S.C. 154(b) by 0 days.

(21) Appl. No.: 12/554,746

(22) Filed: Sep. 4, 2009

(51) Int. Cl.
*B65D 85/20* (2006.01)

(52) U.S. Cl. ..... 206/315.1; 206/467; 206/303; 206/335

(58) Field of Classification Search ..... 206/335, 206/303, 304, 304.1–304.2, 470, 471, 315.1, 206/806; 211/20, 4.21–4.23; 446/75, 78
See application file for complete search history.

(56) References Cited

U.S. PATENT DOCUMENTS

| | | | | | |
|---|---|---|---|---|---|
| 4,128,254 | A | * | 12/1978 | Powell | 280/87.042 |
| 4,315,569 | A | * | 2/1982 | Jaeschke | 229/122 |
| D469,348 | S | * | 1/2003 | Demus et al. | D9/415 |
| D469,686 | S | * | 2/2003 | Yang | D9/415 |
| D470,409 | S | * | 2/2003 | Clarke et al. | D9/415 |

OTHER PUBLICATIONS

Office Action issued on Apr. 19, 2010 in U.S. Appl. No. 12/698,067.

* cited by examiner

*Primary Examiner*—Ehud Gartenberg
*Assistant Examiner*—Raven Collins
(74) *Attorney, Agent, or Firm*—Jeffer Mangels Butler & Mitchell LLP

(57) ABSTRACT

A packaging device preferably including a clam shell, wherein the clam shell is adapted to encase just a wheel of a wheeled toy.

17 Claims, 4 Drawing Sheets

CLAM SHELL PACKAGING FOR WHEEL DEVICE

FIELD OF INVENTION

This invention is related to packaging for wheeled devices and methods of using the same.

BACKGROUND OF THE INVENTION

Wheeled devices, such as skateboards, are normally packaged in boxes or some other bulky structures, such as cardboard boxes. Because of the protruding wheels on such devices, such boxes tend to be very large and tend to take up a large amount of space from the moment they are packaged and placed in inventory to the moment they are placed in retail stores.

BRIEF DESCRIPTION OF THE DRAWINGS

The invention may be more readily understood by referring to the accompanying drawings in which.

SUMMARY OF THE PREFERRED EMBODIMENTS

Figure 1:
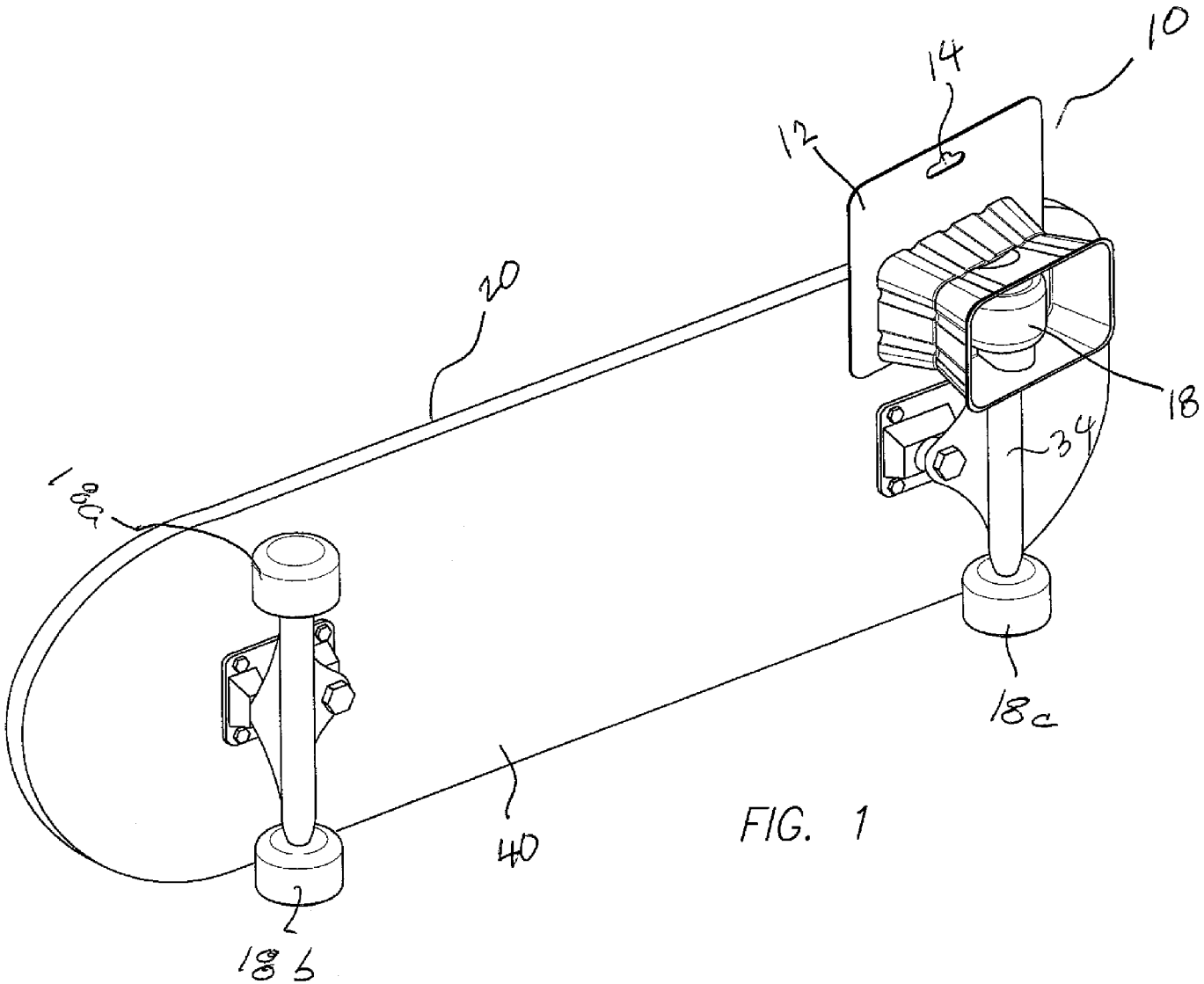
FIG. 1 is a perspective view of a skateboard having a clam shell packaging device in accordance with a preferred embodiment of the present invention.

In accordance with one aspect of the present invention, there is provided a clam shell packaging device. The clam shell packaging device comprises a clam shell, wherein the clam shell is adapted to at least partially encase a single wheel of a device with wheels. The device with wheels may be a skateboard. The clam shell packaging device may include a toy having wheels wherein the wheels of the toy are encased by the clam shell.

In accordance with another aspect of the present invention, there is provided a point of sale display. The point of sale display includes a pegboard; at least one peg extending from the pegboard; and a device having at least one wheel, wherein the wheel is at least partially encased by a clam shell having a tab extending therefrom. Preferably, the tab has an opening the peg passes through the opening. The device may have two wheels, wherein each of the wheels is encased with a clam shell. The device may be a skateboard, wherein the skateboard is hung on the point of sale display, and the skateboard is positioned generally horizontally.

In accordance with another aspect of the present invention, there is provided a method for displaying devices with wheels at a point of sale. The method includes providing a traditional pegboard point of sale display; providing a clam shell packaging device having a tab with an opening therein; at least partially encasing at least one wheel of the device with the clam shell packaging device; and hanging at least two of the devices on the point of sale display.

In accordance with another aspect of the present invention, there is provided a method of reducing space taken up by inventory. The method includes providing a clam shell packaging device comprising a clam shell. The clam shell is adapted to at least partially encase a single wheel of a device with wheels.

In accordance with another aspect of the present invention, there is provided a device with wheels and a wheel holding device combination. The combination includes a device having at least two wheels and means for supporting each of the at least two wheels such that the device with wheels can hang stably from a pegboard. The means for supporting includes an opening through which a peg on the pegboard may pass.

DETAILED DESCRIPTION OF THE PREFERRED EMBODIMENTS

As shown in FIGS. 1-4, the present invention is directed to a clam shell type packing device that encloses at least a portion of at least one of the wheels of a wheeled device, such as a skateboard, and methods of using the same.

It will be appreciated that terms such as "front," "back," "top," "bottom," "left," "right," "above," and "side" used herein are merely for ease of description and refer to the orientation of the components as shown in the figures. It should be understood that any orientation of the components described herein is within the scope of the present invention.

Referring to FIGS. 1-4, the present invention is generally directed to a clam shell structure 10. As used herein, "clam shell structure" may be referred to as "clam shell packaging device" and/or "packaging device" and/or "clam shell." Preferably, the clam shell packaging device 10 encases wheel 18 of the wheeled toy 20 snugly, such that when the clam shell packaging device 10 is hanging the wheeled toy 20 on a pegboard 22, the pegboard 22 is able to support the weight of the wheeled toy 20. As used herein, "wheeled toy" may refer to "a device with wheels," "device" and/or any wheeled device with at least one wheel and is not limited to a "toy."

Figure 2:
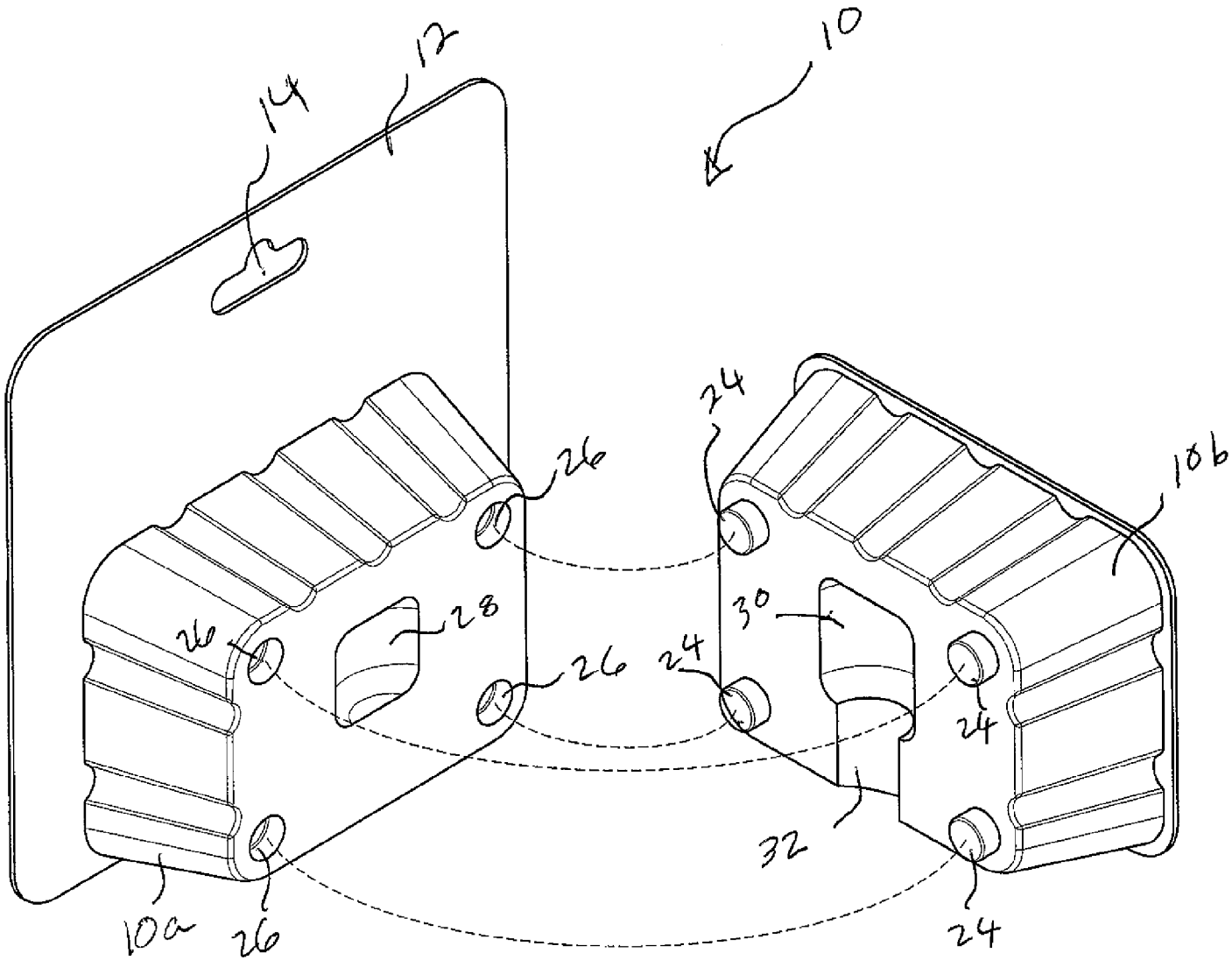
FIG. 2 is an exploded view of the clam shell packaging device of FIG. 1.
Figure 3:
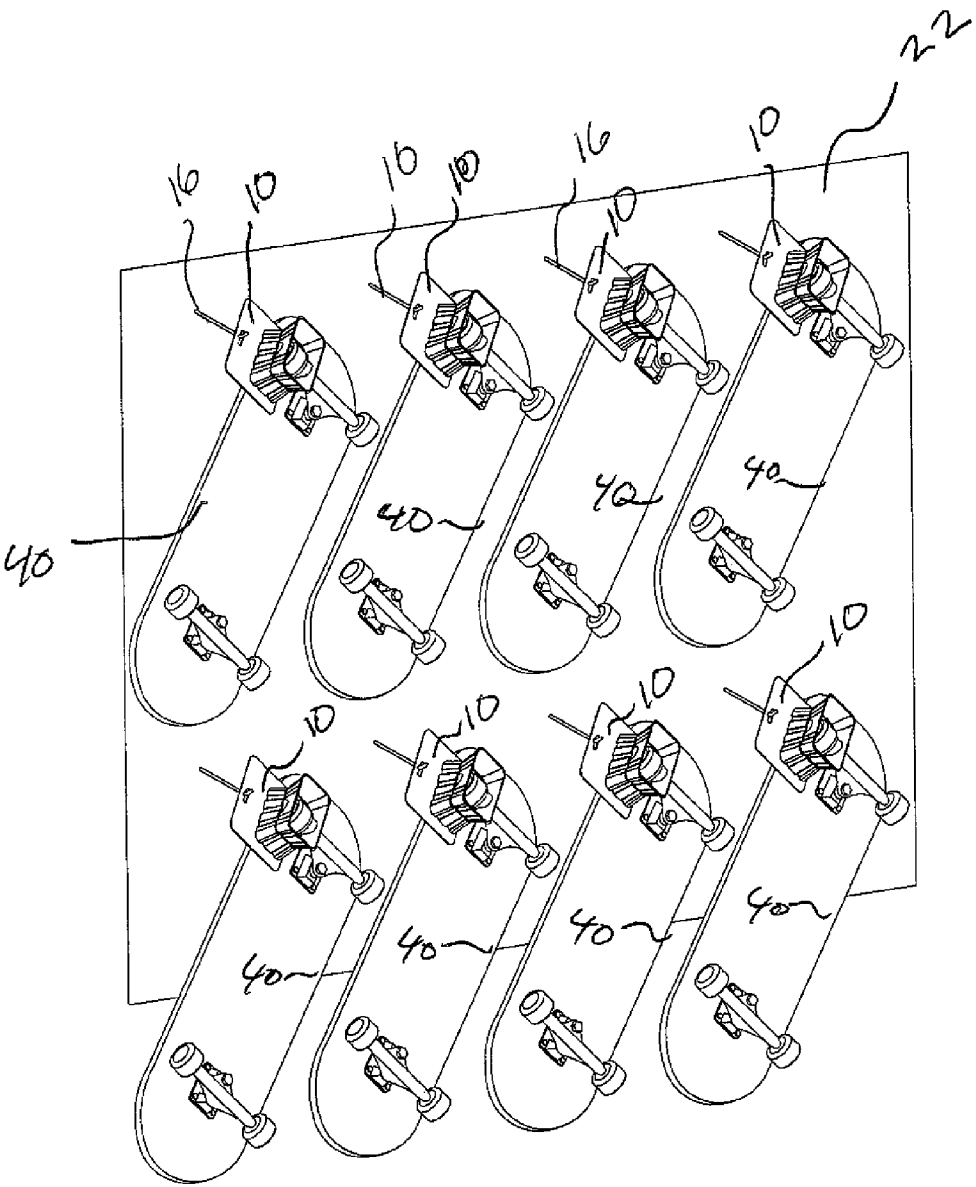
FIG. 3 is a perspective view of a traditional pegboard point of sale display with a number of skateboards each hanging from it via the clam shell packaging device of FIG. 1.

In a preferred embodiment, and as best seen in FIGS. 1 and 2, the clam shell packaging device 10 preferably includes tab 12 having opening 14 allowing it to hang via a nail or pegboard peg. In other embodiments, the clam shell packaging device 10 may include more than one tab and/or more than one opening, as long as the wheeled device is stably supported by the pegboard when hung on display.

In a preferred embodiment, and referring to FIG. 1, the wheeled toy 20 is a skateboard 40. In other embodiments, the wheeled toy 20 may be any other wheeled device as long as it has at least one wheel.

Figure 4:
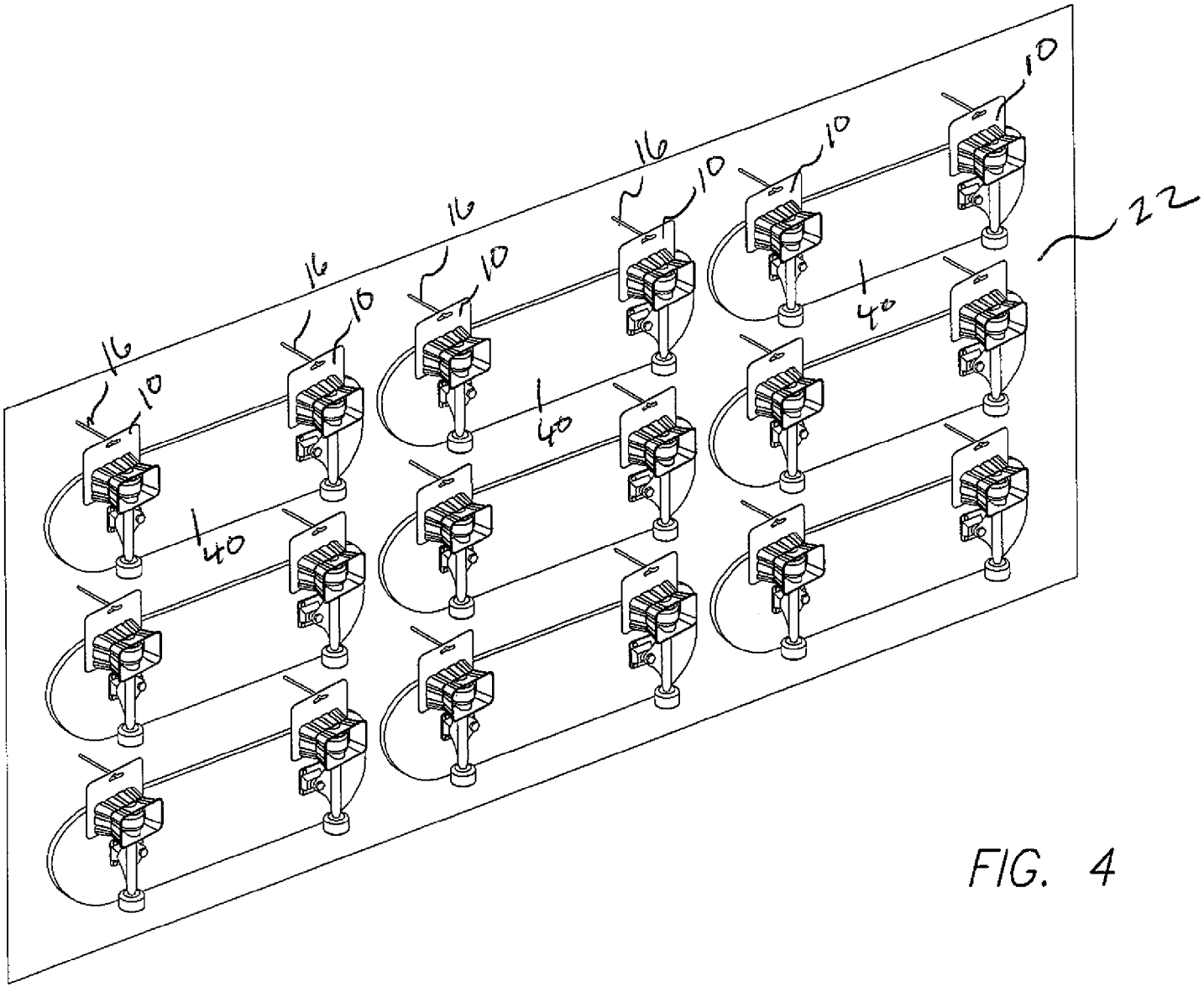
FIG. 4 is a perspective view of a traditional pegboard point of sale display with a number of skateboards each hanging from it via the two clam shell packaging devices of FIG. 1.

In a preferred embodiment, and referring to FIGS. 1 and 4, two clam shell packaging devices 10 encase two wheels 18 and 18*a* (or, alternatively, encase wheels 18*c* and 18*b*) of the wheeled toy 20. Alternatively, a single clam shell packaging device may encase two wheels. In other embodiments, two side wheels 18 and 18*c* (or, alternatively, wheels 18*a* and 18*b*), may be encased by a single clam shell packaging device, or by two claim shell packaging devices. In yet other embodiments, only a single clam shell device encases a single wheel on the wheeled toy.

In a preferred embodiment, and as best seen in FIG. 2, the clam shell packaging device 10 includes two pieces, referred to herein as first piece 10*a* and second piece 10*b*. In other embodiments, the clam shell packaging device may be one piece, such as a bi-fold clam shell, or may be three pieces, such as a tri-fold clam shell.

In a preferred embodiment, and referring to FIG. 2, the first piece 10*a* and the second piece 10*b* may be connected together in a snap lock fashion. As such, the second piece 10*b* preferably includes four projections (referred to herein singly and collectively as "24") for connecting with the first piece

10*a*. The first piece 10*a* preferably includes four depressions (referred to herein singly and collectively as "26") for receiving the projections 24. The first piece 10*a* is connected with the second piece 10*b* when the projections 24 are inserted into the depressions 26 in a snap lock fashion. In other embodiments, the first piece 10*a* and the second piece 10*b* may be connected/attached in any other manner such as fasteners, stapling, sealing, glue, Velcro, or the like.

In a preferred embodiment, and referring to FIGS. 1 and 2, the first piece 10*a* includes tab 12, and pocket 28 for at least partially encasing wheel 18. In a preferred embodiment, the second piece 10*b* includes a pocket 30 for at least partially encasing wheel 18. In addition, the second piece 10*b* preferably includes an opening 32 for receiving truck 34 of a skateboard 40. In other embodiments, the first piece 10*a* may not include pocket 28 or the second piece 10*b* may not include pocket 30. For example, the wheel 28 could be nearly or completely encased by pocket 30 without need for pocket 28. In addition, opening 32 may receive any other device (other than the truck of a skateboard) that supports one or more wheels of the wheeled toy.

In a preferred embodiment, when the first piece 10*a* is attached to the second piece 10*b*, the clam shell packaging device 10 completely or nearly completely and snugly encases wheel 18, and the opening 32 at least partially and snugly encases truck 34 of skateboard 40. In other embodiments, the clam shell packaging device may not completely or nearly completely encase wheel. For example, the clam shell packaging device 10 may at least partially encase wheel 18.

In a preferred embodiment, and as seen in FIGS. 1-4, the opening 14 is designed for a pegboard peg 16 or other similar device such as a nail to pass through the opening 14 such that the wheeled toy 20 may be hung on a traditional pegboard point of display 22. When hung, the weight of the wheeled toy is preferably supported by the pegboard.

In a preferred embodiment, the clam shell packaging device 10 is comprised of polypropylene, polyvinyl chloride ("PVC") and/or polyethylene terephthalate ("PET"). Preferably, the clam shell packaging device 10 is clear. In other embodiments, the clam shell packaging device may be made of any other material or combinations thereof, and/or may not be clear. Preferably, the clam shell packaging device 10 is comprised of a material that allows it to support the wheeled device is hung on display.

In a preferred embodiment, use of the clam shell packaging device of the present invention reduces the amount of space needed for storing/displaying the wheeled toys. Preferably, use of the clam shell packaging as opposed to traditional cardboard packaging reduces the storage/display space needed by at least about 25%, more preferably by at least about 30%, and most preferably by at least about 50%, In a highly preferred embodiment, the storage/display space needed is reduced by at least 56%. Accordingly, the distributor/retailer, for example, has more space available to sell other products and thereby potentially make more profits.

Alternatives to the clam shell structure include other structures or devices which are able to support a skateboard by at least one wheel while the skateboard is hanging from a pegboard. Thus any means for supporting a skateboard by at least one wheel and preferably two wheels such that the skateboard can be stably hung from a pegboard and such that the means for supporting includes an opening through which a peg on a pegboard may pass, are within the scope of the present invention. Such structures include in addition to the clam shell structures, hooks which have two ends, one of which supports a wheel and the other of which has an opening through which the peg can extend; and a hanger or other clip-like structure that can clip onto a wheel and which includes a tab or other such structure with an opening through which a peg can extend.

While certain embodiments of the invention have been described, these embodiments have been presented by way of example only, and are not intended to limit the scope of the inventions. Indeed, the novel methods and elements described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. A clam shell packaging device comprising a clam shell in combination with a toy having at least first and second wheels mounted on a truck, wherein the clam shell includes first and second pieces that cooperate to define a pocket, wherein a portion of the pocket is defined in the first piece and a portion of the pocket is defined in the second piece, wherein the first wheel is received in the pocket, and wherein the truck extends through an opening in one of the first and second pieces to the exterior of the clam shell.

2. The clam shell packaging device of claim 1, wherein the toy is a skateboard having a deck, two trucks and four wheels, wherein the deck is located exterior of the clam shell.

3. The clam shell packaging device of claim 2, wherein a tab is attached to the clam shell.

4. The clam shell packaging device of claim 3, wherein the tab comprises an opening.

5. The clam shell packaging device of claim 4, wherein the clam shell is adapted to stably support the toy when the toy is hung from a nail or pegboard peg.

6. The clam shell packaging device of claim 1, further comprising a second clam shell, and wherein the second wheel is received in the second clam shell.

7. A point of sale display comprising:

(a) pegboard;

(b) at least one peg extending from the pegboard;

(c) a clam shell packaging device comprising a clam shell in combination with a toy having at least first and second wheels mounted on a truck, wherein the clam shell includes first and second pieces that cooperate to define a pocket, wherein a portion of the pocket is defined in the first piece and a portion of the pocket is defined in the second piece, wherein the first wheel is received in the pocket, and wherein the truck extends through an opening in one of the first and second pieces to the exterior of the clam shell, wherein the clam shell has a tab extending therefrom, the tab having an opening; and wherein a peg passes through the opening.

8. The point of sale display of claim 7, wherein at least two of the wheels are encased with separate clam shells.

9. The point of sale display of claim 8, where the device is a skateboard, and wherein the skateboard is hung on the point of sale display, and the skateboard is positioned generally horizontally.

10. A method for displaying devices with wheels and at least one truck at a point of sale, the method comprising:

(a) providing a traditional pegboard point of sale display;

(b) providing a clam shell packaging device that includes first and second pieces that cooperate to define a wheel receiving pocket and a truck opening, wherein the clam shell packaging device has a tab with an opening therein;

(c) at least partially encasing a first wheel of a first device in the wheel receiving pocket, wherein a first truck extends through the truck opening to the outside of the clam shell packaging device; and (d) hanging the device on the point of sale display.

11. The method of claim 10, wherein the devices are skateboards.

12. A method of reducing space taken up by inventory, the method comprising providing the claim shell packaging device of claim 1.

13. A skateboard comprising a deck, two trucks attached to the bottom of the deck, four wheels rotatably attached to the trucks, and means for supporting at least two wheels of the skateboard such that the skateboard can hang stably from a pegboard, wherein the means for supporting comprises first and second clam shell packaging devices, wherein the first clam shell packaging device at least partially surrounds a first wheel and includes an opening through which a portion of a truck extends, wherein the second clam shell packaging device at least partially surrounds a second wheel and includes an opening through which a portion of a truck extends, wherein the deck is located exterior to the first and second clam shell devices, and wherein the first and second clam shell packaging devices each include an opening through which a peg on the pegboard may pass.

14. The clam shell packaging device of claim 1, wherein the first piece includes a plurality of depressions and the second piece includes a plurality of protrusions, and wherein the protrusions are received in the depressions to secure the first piece to the second piece.

15. A device comprising:

a deck, first and second trucks attached to the bottom of the deck, first and second wheels rotatably secured to the first truck and third and fourth wheels rotatably secured to the second truck, and a first clam shell packaging device that includes first and second pieces that cooperate to define a wheel receiving pocket and a truck opening, wherein the first wheel is received in the wheel receiving pocket and the first truck extends through the truck opening to the outside of the first clam shell packaging device, wherein the deck and the second, third and fourth wheels are all located outside of the first clam shell device.

16. The device of claim 15 further comprising a second clam shell packaging device that includes first and second pieces that cooperate to define a wheel receiving pocket and a truck opening, wherein the third wheel is received in the wheel receiving pocket and the second truck extends through the truck opening to the outside of the second clam shell packaging device, wherein the deck and the second and fourth wheels are all located outside of the first and second clam shell devices, and wherein the first truck extends downwardly through the truck opening in the first clam shell packaging device and the second truck extends downwardly through the truck opening in the second clam shell packaging device.

17. The device of claim 16, wherein the first piece of both the first and second clam shell devices includes a plurality of depressions and the second piece of both the first and second clam shell devices include a plurality of protrusions, and wherein the protrusions are received in the depressions to secure the first piece to the second piece.

* * * * *